US008607371B2

(12) United States Patent
Ziegler et al.

(10) Patent No.: US 8,607,371 B2
(45) Date of Patent: Dec. 17, 2013

(54) EMERGENCY TOILET

(75) Inventors: Lutz Ziegler, Lindlar (DE); Rainer Christoph Synder, Lindlar (DE)

(73) Assignees: Marc Collinet, Aachen (DE); Josef Peter Kramer, Cologne (DE)

( * ) Notice: Subject to any disclaimer, the term of this patent is extended or adjusted under 35 U.S.C. 154(b) by 677 days.

(21) Appl. No.: 11/579,823

(22) PCT Filed: May 6, 2005

(86) PCT No.: PCT/DE2005/000862

§ 371 (c)(1),
(2), (4) Date: Nov. 7, 2006

(87) PCT Pub. No.: WO2005/107550

PCT Pub. Date: Nov. 17, 2005

(65) Prior Publication Data

US 2008/0028508 A1 Feb. 7, 2008

(30) Foreign Application Priority Data

May 7, 2004 (DE) ..... 10 2004 23 142

(51) Int. Cl.
*A47K 11/06* (2006.01)

(52) U.S. Cl.
USPC ..... 4/484

(58) Field of Classification Search
USPC ..... 4/144.3, 484; 383/36
See application file for complete search history.

(56) References Cited

U.S. PATENT DOCUMENTS

| | | | | |
|---|---|---|---|---|
| 5,662,630 | A | 9/1997 | Raynie | |
| 6,116,780 | A * | 9/2000 | Young et al. | 383/36 X |
| 6,684,414 | B1 | 2/2004 | Rehrig | |
| 2002/0193762 | A1 | 12/2002 | Suydam | |

FOREIGN PATENT DOCUMENTS

| | | |
|---|---|---|
| DE | 19915454 | 11/2000 |
| FR | 2708465 | 2/1995 |
| GB | 2324291 | 10/1998 |
| WO | WO 2004/012642 | 2/2004 |

OTHER PUBLICATIONS

Written Opinion of the International Searching Authority for International Application No. PCT/DE2005/000862.

* cited by examiner

*Primary Examiner* — Lori Baker
(74) *Attorney, Agent, or Firm* — McCarter & English, LLP

(57) ABSTRACT

The invention relates to an emergency toilet. The toilet includes a bag with an opening. The bag has an external sleeve that is impermeable to liquid and a liquid-absorbent material in its interior.

11 Claims, 1 Drawing Sheet

EMERGENCY TOILET

CROSS REFERENCE TO RELATED APPLICATIONS

This application is the U.S. National Phase of International Application No. PCT/DE2005/000862, filed May 6, 2005, which claims priority to German Application No. DE 10 2004 23 142.7, filed May 7, 2004, the contents of which are expressly incorporated by reference in their entirety as part of the present disclosure.

BACKGROUND

The present invention relates to an emergency toilet for urinating.

Such type emergency toilets are needed wherever it is not possible for a person to use a toilet or another suited location to relieve herself.

This may more specifically be the case when caught in a traffic jam, attending a big event or in other, comparable situations. Such type emergency toilets may also be utilized for persons in need of care or for wheelchair users.

Situations requiring the use of an emergency toilet may also occur in the military, on mobile work places (truck and car drivers, crane drivers, and so on) for example. Other situations are unfavourable surroundings as well as sanitary devices in an unsanitary condition.

Quite small toilets are known and are utilized for camping, in trailers and campers. The document DE 203 10 570 shows an odourless mobile toilet. It is characterized by a complex construction. It comprises for example a toilet bowl, a toilet seat and other parts. Accordingly, it cannot be readily reduced to small packing dimensions, this in turn limiting the mobility of the toilet.

Another emergency urinal has been disclosed in the document DE 199 15 454 A1. It comprises a funnel-shaped collecting apparatus, a flow channel and a connecting device for a urine receptacle. Although this emergency urinal is smaller and, as a result thereof, easier to transport, it also has a great number of parts.

Both emergency toilets mentioned are quite expensive and difficult to clean. Also, the two embodiments described are not easy to transport, they cannot be readily carried on the body for example.

It is the object of the present invention to provide an emergency toilet that can be transported without problem. More specifically, the emergency toilet is intended to be carried on the body, in the most decent way possible. It should be easy and hygienic to use and the manufacturing cost should be the lowest possible.

SUMMARY

In accordance with the invention, this object is solved by an emergency toilet that is formed from a bag having an opening, said bag comprising an external sleeve that is impermeable to liquid and a liquid-absorbent material in its interior.

Accordingly, the emergency toilet of the invention is disposable, in contrast to the known emergency toilets. The advantage thereof is that the emergency toilet needs not be cleaned on the one side and that it may be of extremely small packing dimensions on the other side.

The inventors recognized that a greater benefit is achieved in finding a solution to the object mentioned if they eliminated reusability. They also recognized that small packing dimensions and hygienic use were only to be realized using suited materials.

Since the emergency toilet of the invention can be reduced to extremely small packing dimensions, such as by simply folding it, it may be readily and decently carried on the body. Since it may be carried on the body, the emergency toilet may also be used everywhere, anytime. Pollution due to public urination can be efficiently avoided. Also, the small packing dimensions and also the very light weight make it particularly advantageous for wheelchair users. Wheelchair users anyway are often confronted with situations in which an emergency toilet of the invention would be helpful since toilets are often inaccessible or only difficult to access by wheelchair.

Advantageously, the emergency toilet may be kept folded to small packing dimensions until use by means of bonding strips or adhesive tapes applied on the outside thereof. They may more specifically be implemented for multiple use, meaning so that the bond or adhesive connection can be released and assembled again. Hook and loop fasteners or similar are suited for this purpose for example. It may also be envisaged to seal discrete folded emergency toilets in one foil. On the one side, the emergency toilet is thus protected against environmental influences such as humidity, on the other side, the packing dimensions may be further reduced, using a suited shrink-wrapping process. A plurality of emergency toilets, which may at need be shrink-wrapped individually, may also be sold together in a bulk pack.

In another implementation variant, which is particularly advantageous, a superabsorbing material is provided in the bag of the emergency toilet. This material is preferably connected to the inner side of the liquid-impermeable external sleeve. The term superabsorbing material refers for example to polymers that are capable of absorbing liquid in an amount multiple of the own mass and of forming a gel upon absorption of the liquid. It is known to use such type superabsorbing materials in diapers. As contrasted with other absorbing materials, superabsorbing materials have a relatively small volume and a greater capacity of retaining the absorbed liquid when subjected to a pressure. They are stable to ageing and toxicologically harmless. Lightly reticulated, synthetic polymers are often used. These include for example polymers and copolymers on the basis of acrylic acid or acrylamite. They are hardly soluble in water. Starch-based superabsorbers such as starch-acrylonitrile graft polymers, gelatinized starch derivatives or cellulose-based derivatives are also known. Further, superabsorbers based on polyose (hemicelluloses) are known. The superabsorbing materials mentioned are only examples, all suited materials being allowed to be used within the scope of the invention.

It has been found that the emergency toilet is particularly advantageous if a flexible tube is connected to the opening in the bag, said flexible tube also being formed from a liquid-impermeable material. At its free end, said flexible tube comprises a tube opening through which the person may urinate into the bag. Although any length may be chosen for the flexible tube, it has been found that a length of about 10 to 20 cm is particularly suited. The diameter of the tube opening may for example range from 6 to 10 cm, but it may also be greater or smaller. The diameter of the tube may equal the diameter of the tube opening although it may also be smaller. It may for example taper conically.

The tube opening is preferably kept open by an integrated ring. The ring may be configured to be a spreader ring or a flap ring so as to be capable of additionally performing a sealing function. The ring is preferably made from a strong, difficult-to-deform material. The flexible tube may be lined on its inner side with superabsorbing material as well, so that no liquid is allowed to flow out of the flexible tube, when the emergency toilet is folded after use.

In a particularly advantageous implementation variant, the flexible tube projects into the bag, preferably by a third of the overall length of the bag. The portion of flexible tube projecting into the bag is chosen so as to make certain that urine is received in the bag from the bottom thereof. This is advantageous because otherwise the superabsorbing material gelatinizing at the entrance or in the upper portion of the bag could clog the opening or the access while urinating.

The emergency toilet of the invention in accordance with the embodiment described herein above is easy and convenient to use. The ring integrated in the flexible tube is taken hold of with one hand so that the bag is freely suspended from the tube. The penis of the man may be held or introduced into the tube through the tube opening so that hygienic and clean use of the emergency toilet is ensured. In principle, the emergency toilet may be used in any position of the user, meaning standing, sitting, squatting and even lying. The last position is very advantageous for use with bedridden persons.

After use, the flexible tube is folded and preferably fixed using one or several adhesive tapes located on the outer side of the bag. There may also be provided a cover plate for sealing the tube opening. This may be particularly provided for when the ring does not perform any sealing function, although it may also be used in addition thereto. In principle however, a seal is not absolutely necessary if a superabsorbing material is being used since the latter prevents the urine from flowing back anyway. Also, superabsorbing material reduces malodors.

BRIEF DESCRIPTION OF THE DRAWINGS

The invention will be better understood upon reading the following description of the Figures. Other advantageous implementation features will become apparent from the also appended claims. In principle, it should be noted that all the implementation variants are given by way of example only and that the invention is not intended to be limited thereto. In the drawing:

DETAILED DESCRIPTION

Figure 1:
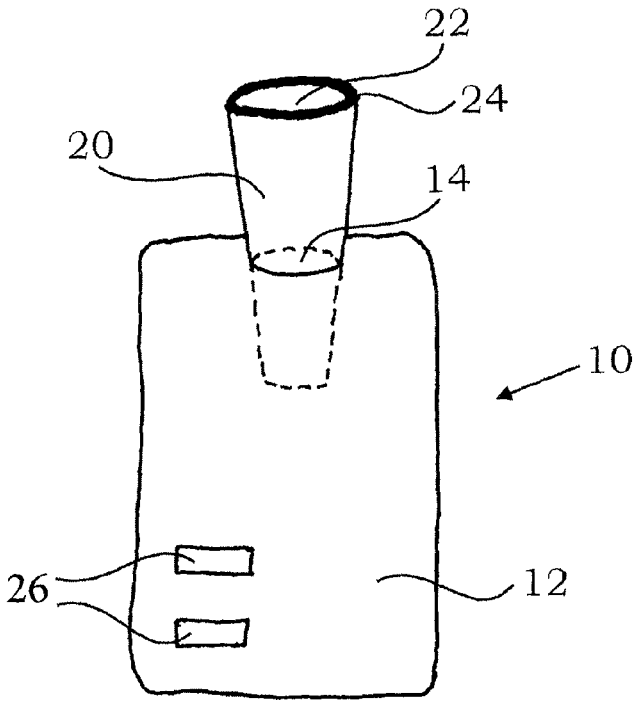
FIG. 1 shows a schematic diagram of an emergency toilet of the invention.
Figure 2:
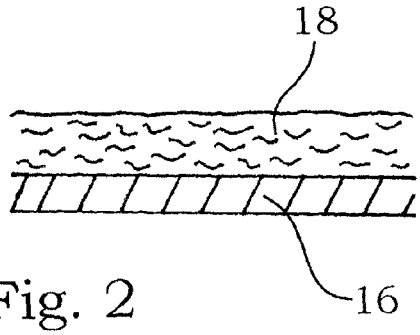
FIG. 2 shows a cross-sectional view of a detail of the bag of the invention.

Referring to FIG. 1, an emergency toilet 10 of the invention consists of a bag 12 with an opening 14. FIG. 2 in turn makes apparent the structure of the bag 12 or of the material from which it is made. Accordingly, the bag 12 has a liquid-impermeable external sleeve 16 on the inner side of which there is disposed a liquid absorbing material 18. Said material may be solidly connected to the external sleeve, but may also be loose within the bag 12. Advantageously, the absorbing material 18 is a superabsorbing material that is preferably biodegradable. The external sleeve 16 consists of a flexible, foldable material. Plastic materials that are also used for the external sleeve of diapers are suited for example.

It has been found that the bag 12 should be capable of holding a liquid volume of about 500 ml. Depending on the needs or implementation, the capacity may also be higher or lower.

In the present exemplary embodiment, a flexible tube 20 adjoins the opening 14 or a flexible tube 20 extends through said opening 14. At its free end, said flexible tube has a tube opening 22. It has been found that it is advantageous if the flexible tube 20 has a conical basic shape, tapering from its free end towards the bag 12. Further, the flexible tube 20 extends into the interior of the bag 12, with about one third of its length in the exemplary embodiment shown. It is preferred that the interior of the flexible tube 20 be also lined with a superabsorbing material.

The tube opening 22 is kept open with the help of an integrated ring 24. Said ring may for example comprise two diametrically opposed flap hinges that are intended to snap-fit in the opened position so that the ring may concurrently act as a sealing device (not shown).

Figure 3:
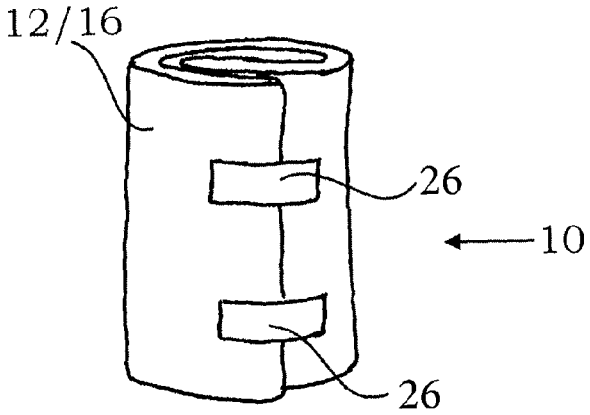
FIG. 3 shows a schematic diagram of an emergency toilet in the folded state.

Further, there are shown by way of example two bonding strips 26 that are disposed on the external sleeve 16 of the bag 12. FIG. 3 clearly shows that the emergency toilet 10 may be reduced to a small handy size with the help of these bonding strips 26. Any other type of fixation may be used instead of such bonding strips 26.

For the first time, the invention provides for an emergency toilet 12 that may be reduced to a minimum size. This toilet is extremely hygienic and easy to use and at the same time manufacturable at very low cost. The embodiment described is particularly suited for men, although the shape may be modified so that the emergency toilet 12 may also be used for women.

It has been found that the external sleeve 16 should hold a liquid volume of about 500 ml. Depending on needs or implementation, the capacity may however be higher or lower.

In the present exemplary embodiment, a flexible tube 20 adjoins the opening 14 or a flexible tube 20 extends through said opening 14. At its free end, said flexible tube has a tube opening 22. It has been found that it is advantageous if the flexible tube 20 has a conical basic shape, tapering from its free end towards the bag 12. Further, the flexible tube 20 extends into the interior of the bag 12, with about a third of its length in the exemplary embodiment shown. It is preferred that the interior of the flexible tube 20 be also lined with a super absorbing material.

The tube opening 22 is kept open with the help of an integrated ring 24. Said ring may for example comprise two diametrally opposed flap hinges that are intended to snap-fit in the opened position so that the ring may concurrently act as a sealing device (not shown).

Further, there are shown by way of example two bonding strips 26 that are disposed on the external sleeve 16 of the bag 12. FIG. 3 clearly shows that the emergency toilet 10 may be reduced to a small handy size with the help of these bonding strips 26. Any other type of fixation may be used instead of such bonding strips 26.

For the first time, the invention provides for an emergency toilet 12 that may be reduced to a minimum size. This toilet is extremely hygienic and easy to use and at the same time manufacturable at very low cost. The embodiment described is particularly suited for men, although the shape may be modified so that the emergency toilet 12 may also be used for women.

The external sleeve 16 may for example be formed from ethylene vinyl acetate (polymer). This material is particularly suited because it is reliably impermeable to liquids on the one side and on the other side because it may be processed to have a very small thickness and is finally very soft and, as a result thereof, readily deformable. This latter feature is particularly sensible since the emergency toilet 10 is intended to be foldable to the smallest possible size.

The superabsorbing material 18 may preferably be disposed in an inner bag that may be made from fleece. Such a fleece, for example a nonwoven fleece made from polypropylene (card web) or a fleece having as high as possible a cotton percentage, is liquid permeable, but it securely envelops the superabsorbing material 18. The advantage thereof is that the superabsorbing material 18 is prevented from falling or slipping accidentally from the bag 12. The inner bag itself has an inner volume sufficient to accommodate even a swollen superabsorbing material 18. In order to ensure a small size, the inner bag is formed in such a manner that it may be extended from a flat-lying position to its final size. For this purpose, suited darts may be provided for.

In order to prevent the inner bag from slipping from the bag 12, its dimensions in the flat-lying condition are greater than the inner diameter of the flexible tube 20. The inner bag may only be extracted from the quite narrow flexible tube 20 if it is being compressed. It is however also possible to nonreleasably secure the inner bag in the bag 12, such as by gluing.

Finally, an intermediate material may preferably be introduced between the inner bag and the external sleeve 16, said intermediate material acting as an additional protecting sleeve for the inner bag or the superabsorbing material 18. In addition, such an intermediate layer, which is for example made from a cotton-like material, provides the bag 12 with a more pleasant touch.

On its inner side, the tube opening 22 comprises portions made from a textile, such as a fleece, said portions extending from the border region into the interior of the flexible tube. These textile portions or loose-hanging pieces of cloth make it even more difficult for the liquid to flow out of the bag 12, said liquid being retained or absorbed by the pieces of cloth located inside.

In another implementation variant of the invention, the tube opening 22 is adjoined with an apron hanging towards the outside. The user of the toilet places his fingers holding the bag 12 underneath said apron. After use, this overhanging material may be pushed upward, meaning over the rim of the tube opening, and finally into the tube opening 22. Then, the apron serves as an additional seal. The apron may either be implemented in parts or surround the entire tube opening 22.

Finally, there are preferably provided bonding strips 26 that serve in particular to seal the emergency toilet 10 after use. Sealing may also be achieved by rolling the flexible tube 20 toward the bag 12 and by fixing it in an end position with the help of a bonding strip 26 disposed accordingly.

The external sleeve 16 is preferably formed from one piece of tubular film that is given the corresponding shape and welded. Tubular film is an extremely low cost film so that the manufacturing cost of the emergency toilet 10 is significantly reduced using such a film. The final shape of the external sleeve 16 may be achieved by ultrasonic welding, with projecting portions being cut off although they may also remain there since they do not disturb. This also permits to reduce the manufacturing costs.

In a first embodiment, the bag 12 has an overall length, from the tube opening 22 to the opposite end, of approximately 35 cm, the width of the bag 12 is about 13.5 cm, the width of the tube about 10 cm. The dimensions mentioned are those of a flat-lying bag 12. The inner bag has a width of about 12.5 cm and a length of about 15.5 cm. Commencing at the tube opening 22, the length of the tube is about 17 cm, from there, the width widens over a segment of about 6 cm before reaching the final width of 13.5 cm. Accordingly, the inner bag is secured in the width portion of the bag 12 and cannot readily slip out thereof. The inner diameter of the tube opening is about 6-7 cm. In the exemplary embodiment described, the external sleeve is made from one piece, i.e., the external sleeve 16 itself forms the bag 12 and the flexible tube 20.

The invention claimed is:

1. An emergency toilet comprising a bag including a liquid-impermeable external sleeve formed from one-piece foldable tubular film and having an opening and a flexible tube and comprising a liquid-superabsorbing material in an interior thereof, at least one bonding strip applied on an outside thereof adapted to maintain the bag folded in a small packing size before use, wherein the tube includes a tube opening kept open by an integrated ring and wherein the bag is in an unused condition;

the bag is in a folded condition; and the at least one bonding strip is maintaining the unused, folded bag in said folded condition.

2. An emergency toilet as defined in claim 1, wherein the flexible tube extends through the opening and projects into the bag, and wherein the tube opening is located at a free end of the tube.

3. An emergency toilet as defined in claim 1, wherein the flexible tube is lined on an inner side with absorbing material.

4. An emergency toilet as defined in claim 1, wherein the integrated ring is made from a deformable material.

5. An emergency toilet as defined in claim 1, wherein the flexible tube has a conical shape, and has a cross-section diminishing from the tube opening.

6. An emergency toilet as defined in claim 2, wherein about one third of an overall length of the flexible tube projects into the bag.

7. An emergency toilet as defined in claim 3, wherein the absorbing material is a superabsorbing material.

8. An emergency toilet as defined in claim 1, wherein the at least one bonding strip is adapted to be released from the bag so as to permit unfolding thereof.

9. An emergency toilet as defined in claim 1, wherein the at least one bonding strip is further adapted to be reapplied to the bag after use.

10. An emergency toilet as defined in claim 1, wherein the at least one bonding strip is adapted to seal the toilet after use.

11. An emergency toilet as defined in claim 1, wherein the at least one bonding strip is adapted to be released from the bag multiple times so as to permit multiple uses of the emergency toilet.

* * * * *